US005124204A

United States Patent [19]

Yamashita et al.

[11] Patent Number: 5,124,204

[45] Date of Patent: Jun. 23, 1992

[54] THIN FILM ELECTROLUMINESCENT (EL) PANEL

[75] Inventors: Takuo Yamashita, Tenri; Masaru Yoshida; Shigeo Nakajima, both of Nara; Keiichi Uno; Yoshiki Murakami, both of Otsu, all of Japan

[73] Assignee: Sharp Kabushiki Kaisha, Osaka, Japan

[21] Appl. No.: 678,175

[22] Filed: Mar. 29, 1991

Related U.S. Application Data

[63] Continuation of Ser. No. 379,250, Jul. 13, 1989, abandoned.

[30] Foreign Application Priority Data

Jul. 14, 1988 [JP] Japan ..... 63-175569

[51] Int. Cl.[5] ..... H01J 1/70

[52] U.S. Cl. ..... 428/331; 313/512; 313/506; 428/690; 428/917

[58] Field of Search ..... 313/512, 506; 428/690, 428/331, 917

[56] References Cited

U.S. PATENT DOCUMENTS

| | | | |
|---|---|---|---|
| 3,182,209 | 5/1965 | Fruin et al. | 307/88.5 |
| 4,104,555 | 8/1978 | Fleming | 313/512 |
| 4,336,523 | 6/1982 | Jaggi | 365/160 |
| 4,357,557 | 11/1982 | Inohara et al. | 313/512 |
| 4,767,674 | 8/1988 | Kawachi | 313/512 |

FOREIGN PATENT DOCUMENTS

| | | | |
|---|---|---|---|
| 0019715 | 4/1980 | European Pat. Off. . | |
| 3010164 | 9/1980 | Fed. Rep. of Germany . | |
| 1381497 | 10/1963 | France . | |
| 36-290693 | 12/1961 | Japan . | |
| 0072197 | 6/1977 | Japan | 313/512 |
| 0083196 | 6/1980 | Japan | 313/512 |
| 63-057230 | 3/1988 | Japan . | |
| 8908919 | 9/1989 | PCT Int'l Appl. . | |
| 1501878 | 2/1978 | United Kingdom | 313/512 |

*Primary Examiner*—James J. Seidleck

*Attorney, Agent, or Firm*—Birch, Stewart, Kolasch & Birch

[57] ABSTRACT

Disclosed is a thin film EL panel having a high reliability. The thin film El panel is thin, light, and is made at a low cost. The present invention provides in a thin film electroluminescent (EL) panel comprising a light permeable base plate, a thin film EL element formed on the base plate and a moisture-proof sheet covered thereon, an improvement residing in that a moisture-absorption sheet is placed between said thin film EL element and said moisture-proof sheet, and said moisture-absorption sheet comprises an organic polymer sheet with silica gel powder dispersed therein at a certain surface density. The present invention also provides in a thin film electroluminescent (EL) panel comprising a light permeable base plate, a thin film EL element formed on the base plate and a moisture-proof sheet covered thereon, an improvement residing in that a moisture-absorption layer is formed on the inside surface of the moisture-proof sheet by coating powder thereon having moisture absorption properties.

16 Claims, 2 Drawing Sheets

THIN FILM ELECTROLUMINESCENT (EL) PANEL

FIELD OF THE INVENTION

This application is a continuation of application Ser. No. 07/379,250 filed on Jul. 13, 1989 now abandoned.

The present invention relates to a thin film electroluminescent (EL) panel used for a display of a personal computer and a word processer.

BACKGROUND OF THE INVENTION

A conventional thin film EL panel, as shown in FIG. 2, is prepared by forming on a glass base plate 2 a lower transparent electrode 3, a lower insulating layer 4, a luminescent layer 5, an upper insulating layer 6 and an upper electrode 7 in this order. The constitution of the layers 3 to 7 is called EL element 1. In order to prevent from reaching moisture to the EL element, the EL element is covered by a glass cover 8 which is adhere to the glass base plate 2 by an epoxy adhesive agent 9. In order to further enhance reliability against moisture, silicone oil containing silica gel powder is encapsulated between the glass cover 8 and the EL element 1 through a hole 17 of the glass cover 8. The hole 17 is sealed by a low vapor pressure resin 'TORR SEAL' (Varian Associate U.S.A.) 11.

However, since the glass cover 8 has to have a certain thickness to ensure protective function, the thin film EL panel is thick and heavy. It is therefore difficult to make the panel thin and light. Also, since the glass cover 8 and the silicone oil are relatively expensive, cost down is difficult. Further, the encapsulating process of the silicone oil takes a long time and complicated.

Japanese Kokai Publication (unexamined) 290693/1986 proposes that a laminate film is used to prevent the EL element from moisture. This element does not pay an attention on absorbing moisture, so that its reliability is low.

SUMMARY OF THE INVENTION

The present invention provides a thin film EL panel having a high reliability. The thin film EL panel is thin, light, and low cost. The present invention provides in a thin film electroluminescent (EL) panel comprising a light permeable base plate, a thin film EL element formed on the base plate and a moisture-proof sheet covered thereon, an improvement residing in that a moisture-absorption sheet is placed between said thin film EL element and said moisture-proof sheet, and said moisture-absorption sheet comprises an organic polymer sheet and silica gel dispersed therein in a certain surface density.

The present invention also provides in a thin film EL panel comprising a light permeable base plate, a thin film EL element formed on the base plate and a moisture-proof sheet covered thereon, an improvement residing in that a moisture-absorption layer is formed on the inside surface of the moisture-proof sheet by coating powder having moisture absorption properties.

The EL element of the present invention is prepared by forming on a light permeable base plate a lower transparent electrode, a lower insulation layer, an electroluminescent layer, an upper insulation layer and an upper electrode in this order. Either the lower insulation layer or the upper insulation layer can be eliminated.

PREFERRED EXAMPLES OF THE PRESENT INVENTION

Figure 1A:
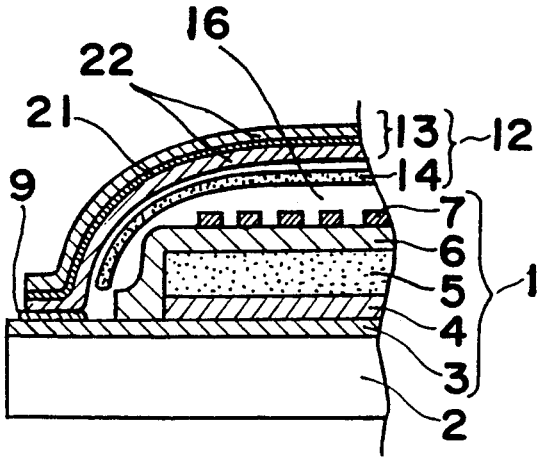
FIGS. 1 (*a*) and (*b*) show enlarged vertical sectional views of the thin film EL panel of the present invention.
Figure 1B:
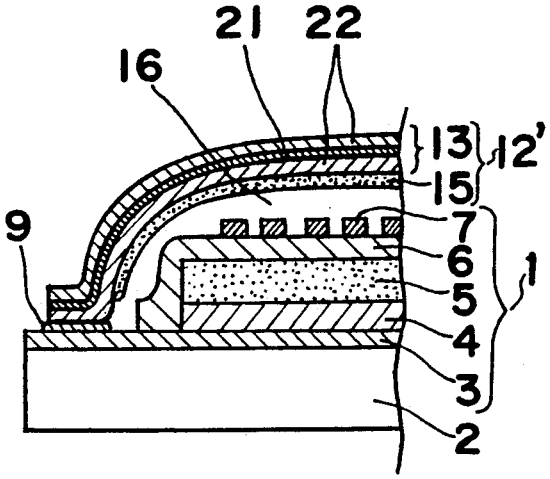
Figure 2:
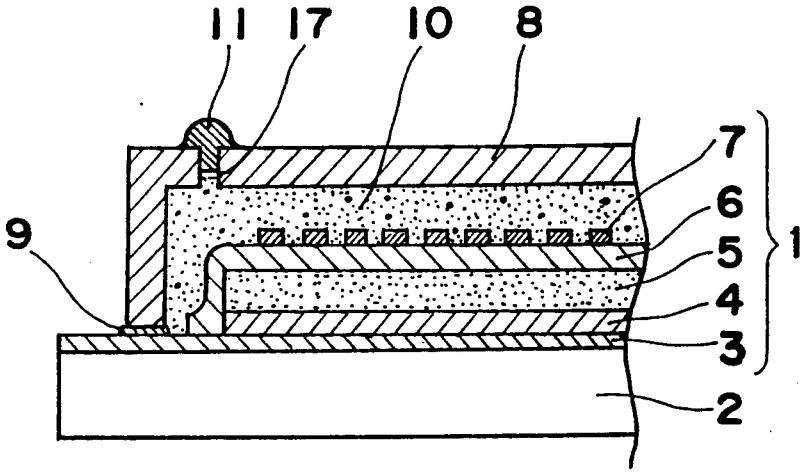
Fig. 2 PRIOR ART
FIG. 2 shows an enlarged vertical sectional view of the conventional thin film EL panel.

FIGS. 1 (*a*) and (*b*) show enlarged vertical sectional views of the thin film EL panel of the present invention. The same elements are shown using the same number.

In FIG. 1 (*a*), 1 shows an EL element which is prepared by forming on a light permeable base plate 1 (e.g. a glass base plate) a lower transparent electrode 3, a lower insulation layer 4, an electroluminescent layer 5, an upper insulation layer 6 and an upper electrode 7 in this order. Either the lower insulation layer 4 or the upper insulation layer 6 can be eliminated.

12 shows a sealing sheet which is composed of a moisture-proof sheet 13 and a moisture-absorption sheet 14. The EL element 1 is covered with the sealing sheet 12 of which the moisture-proof sheet 13 is outside. The sealing sheet 12 covers over the EL element as forming a space 16 and the peripheral portion of the sealing sheet 12 is bonded by an epoxy resin 9 to the permeable base plate 2 on which the lower transparent electrode 3 or the upper transparent electrode 7 may be present. The moisture-proof sheet 13 may be formed larger than the moisture-absorption sheet 14 so that, as shown in FIG. 1, only the peripheral portion of the moisture-proof sheet 13 is used for bonding.

It is preferred that the moisture-proof sheet 13 of the sealing sheet 12, as shown in FIG. 1, comprises two organic films 22 (e.g. a polyester film) having a thickness of 5 to 50 micrometer and a metal film 21 (e.g. aluminum) having a thickness of 5 to 50 micrometer sandwiched therebetween. In this preferred construction, moisture-proof properties are brought about by the metal film 21. The organic films 22 act as a protection of the metal film 21 and an insulation of the EL element.

The sealing sheet 12 is generally bonded quickly to the permeable base plate 2 in dried nitrogen gas, after heating the element 1 to 200° C. to remove water content from the EL element 1. But, little water content remains by all means. Also, water content would leak in from the bonded portion while the plate works for a long time. Such water content is absorbed into the moisture-absorption sheet 14, according to the present invention.

The moisture-absorption sheet 14 is an organic polymer sheet dispersed with silica gel powder having a particle size of 1–4 micron, preferably 15 micron in a certain surface density, preferably 10 to 500 g/m$^2$. The organic polymer sheet can be any polymers, for example natural polymers, such as cellulose, protein and the like; modified natural polymers, such as nitrocellulose, acetylcellulose, cyanoethylecellulose, hydroxyethylcellulose, carboxymethylcellulose and the like; synthetic polymer, such as vinyl polymers (e.g. polyethylene, polypropylene, polyvinylalcohol, polyvinylacetate, polyacrylate, polyvinylchloride, polyvinylidenechloride, polyvinylfluoride, polyvinylidenefluoride), condensation polymers (e.g. polyester, polyamide), thermosetting polymers (e.g. epoxy resin, phenol resin, melamine resin); a mixture thereof; a composite thereof; and the like. The sheet can be any form, such as film, paper, nonwoven fabric, woven fabric and the like. If it is in the form of film, preferred is polyvinylalcohol, polyamide, hydroxyethylcellulose, carboxymethylcellulose and the like. In the form of paper, cellulose is preferred. In the form of non-woven fabric, thermoplastic resin (e.g. polyethylene, polypropylene, polyester etc.) is preferred. The moisture-absorption sheet 14 preferably has a thickness of 0.01 to 1 mm. If the sheet 14 is thicker than 1 mm, it obstructs the bond of the sheet 12 to the base plate 2. The moisture-absorption sheet 14 may be either bonded to the moisture-proof sheet 13 or inserted between the EL element 1 and the moisture-proof sheet 13.

If the moisture-absorption sheet 14 of the embodiment of FIG. 1 (*a*) is replaced by the moisture-absorption layer 15, the second embodiment of the present invention is formed as shown in FIG. 1 (*b*). The moisture-absorption layer 15 can be prepared by coating silica gel powder on the inside surface of the moisture-proof sheet 13. The silica gel powder is preferably dispersed in a surface density amount of 10 to 500 g/m$^2$.

Figure 3:
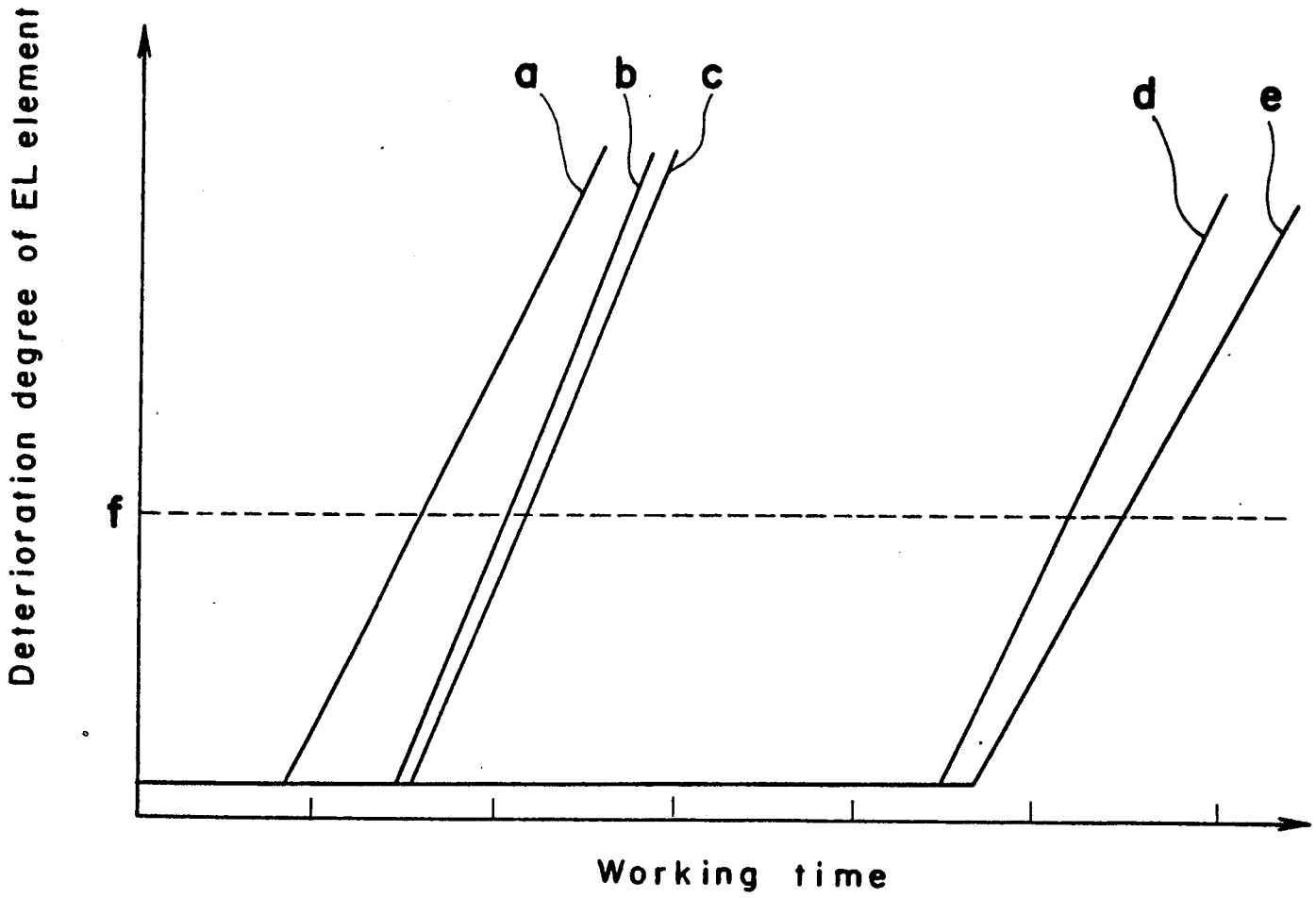
FIG. 3 is a graph showing a deterioration degree of the thin film EL panel of the present invention versus working time.

In both embodiments of FIGS. 1 (*a*) and (*b*), an amount of silica gel powder is determined by an experiment of FIG. 3. The experiment was carried out by changing an amount of silica gel powder and placing the panel at an elevated temperature and a high humidity to determine deterioration degree. The results are expressed as a graph in FIG. 3.

In FIG. 3, a shows a thin film EL panel without the moisture-absorption sheet or layer, b shows one having a surface density of 0.1 g/m$^2$, c is 1 g/m$^2$, d is 10 g/m$^2$ and e is 500 g/m$^2$. A line expressed as f in FIG. 3 is a limit over which a quality of a thin film EL panel is bad. As is apparent from FIG. 3, surface densities more than 10 g/m$^2$ significantly lengthen a life span of the panel. It is very difficult from a technical view point to disperse silica gel powder in a surface density of more than 500 g/m$^2$. Technical effects do not increase in proportion to the increase of surface density. Accordingly, a surface density of silica gel powder is defined as within the range of 10 to 500 g/m$^2$.

In order to enhance display contrast, it is preferred that the moisture-absorption sheet 14 and layer 15 are colored black or near black.

In the Examples, the EL element of dot-matrix type is explained, but the present invention may also be applied to an element of dot-matrix type.

According to the present invention, since the moisture-absorption sheet or layer is present between the moisture-proof sheet and the EL element, the thin film EL panel has a long life span. The present invention can realize to make light and thin in comparison with conventional techniques.

The present invention has no process for pouring silicone oil and easily produces the thin film EL panel, it makes low cost.

Further, if the moisture-absorption sheet or layer is colored black, it enhances the contrast of display.

What is claimed is:

1. In a thin film electroluminescent (EL) panel comprising a light permeable base plate, a thin film EL element formed on the base plate and a moisture-proof sheet covered thereon, an improvement comprising a moisture-absorption sheet disposed between said thin film EL element and said moisture-proof sheet, wherein said moisture-absorption sheet comprises an organic polymer sheet with silica gel powder dispersed therein at a surface density of 10–500 g/m$^2$.

2. The thin film EL panel according to claim 1 wherein said moisture absorption sheet has a thickness of 0.01 to 1 mm.

3. The thin film EL panel according to claim 1 wherein said moisture absorption sheet is colored black.

4. The thin film EL panel according to claim 1 wherein said thin film EL element comprises a lower transparent electrode formed on said base plate, a lower-insulation layer formed on said lower transparent electrode, an electroluminescent layer formed on said lower insulation layer, an upper insulation layer formed on said electroluminescent layer and an upper electrode formed on said upper insulation layer.

5. The thin film EL panel according to claim 1 wherein said thin film EL element comprises a lower transparent electrode formed on said base plate, an electroluminescent layer formed on said lower transparent electrode, an upper insulation layer formed on said electroluminescent layer and an upper electrode formed on said upper insulation layer.

6. The thin film EL panel according to claim 1 wherein said thin film EL element comprises a lower transparent electrode formed on said base plate, a lower insulation layer formed on said lower transparent electrode, an electroluminescent layer formed on said lower insulation layer and an upper electrode formed on said electroluminescent layer.

7. The thin film EL panel according to claim 1 wherein said moisture-proof sheet comprises a metal film disposed between two organic films.

8. The thin film EL panel according to claim 10 wherein said organic films comprise polyester films and said metal film comprises aluminum.

9. The thin film EL panel according to claim 10 wherein said organic films and said metal film of said moisture-proof sheet each have a thickness of 5 to 50 μm.

10. The thin film EL panel according to claim 1 wherein said silica gel powder has a particle size of 1–4 microns.

11. In a thin film EL panel comprising a light permeable base plate, a thin film EL element formed on the base plate and a moisture-proof sheet covered thereon, an improvement comprising a moisture-absorption layer formed on the inside surface of the moisture-proof sheet by coating thereon silica gel powder having moisture absorption properties at a surface density of 10 to 500 g/m$^2$.

12. The thin film EL panel according to claim 3 wherein said moisture absorption layer is colored black.

13. The thin film EL panel according to claim 3 wherein said moisture-proof sheet comprises a metal film disposed between two organic films.

14. The thin film EL panel according to claim 11 wherein said organic films comprise polyester films and said metal film comprises aluminum.

15. The thin film EL panel according to claim 11 wherein said organic films and said metal film of said moisture-proof sheet each have a thickness of 5 to 50 μm.

16. The thin film EL panel according to claim 3 wherein said silica gel powder has a particle size of 1–4 microns.

* * * * *